US010258133B2

(12) United States Patent
Beck et al.

(10) Patent No.: US 10,258,133 B2
(45) Date of Patent: Apr. 16, 2019

(54) DECORATIVE DEVICE WITH INTERCHANGEABLE DECORATIONS

(71) Applicants: Jason Beck, Pettisville, OH (US); Charlene Beck, Pettisville, OH (US)

(72) Inventors: Jason Beck, Pettisville, OH (US); Charlene Beck, Pettisville, OH (US)

( * ) Notice: Subject to any disclaimer, the term of this patent is extended or adjusted under 35 U.S.C. 154(b) by 0 days.

(21) Appl. No.: 14/564,080

(22) Filed: Dec. 8, 2014

(65) Prior Publication Data

US 2016/0157576 A1 Jun. 9, 2016

(51) Int. Cl.
*A45D 8/26* (2006.01)
*A45D 8/00* (2006.01)

(52) U.S. Cl.
CPC ..... *A45D 8/26* (2013.01); *A45D 2008/006* (2013.01)

(58) Field of Classification Search
CPC ..... A45D 2008/00; A45D 2008/02; A45D 2008/004; A45D 2008/006; A45D 8/26; A45D 8/24; A45D 8/20; A45D 8/22
USPC ..... 132/273, 275
See application file for complete search history.

(56) References Cited

U.S. PATENT DOCUMENTS

| | | | | |
|---|---|---|---|---|
| 4,912,944 | A * | 4/1990 | Crosley et al. | 63/29.2 |
| 4,991,607 | A * | 2/1991 | Chen | A45D 8/24 132/278 |
| 5,154,196 | A * | 10/1992 | Moffat | A45D 8/24 132/275 |
| 5,722,437 | A * | 3/1998 | Chang | A45D 8/24 132/275 |
| 5,771,908 | A * | 6/1998 | Dorsey | 132/275 |
| 5,857,469 | A * | 1/1999 | Sowell | 132/275 |
| 5,893,377 | A * | 4/1999 | Chen | 132/275 |
| 6,142,158 | A * | 11/2000 | Lloyd et al. | 132/275 |
| 6,386,208 | B1 * | 5/2002 | Reid | 132/275 |

* cited by examiner

*Primary Examiner* — Tatiana L Nobrega
*Assistant Examiner* — Brianne E Kalach

(57) ABSTRACT

The present disclosure is directed to a decorative item with an interchangeable portion. The presently disclosed device can be attached to the hair, clothing, or other suitable surface and has an interchangeable decorative feature that does not require the purchase of a large number of similar items to vary the appearance of the decorative item. The preferred embodiment of the device is similar in nature to a barrette with the inclusion of two attachment means on opposing ends of the barrette. The interchangeable decorations can be attached to the attachment means on the barrette.

1 Claim, 2 Drawing Sheets

DECORATIVE DEVICE WITH INTERCHANGEABLE DECORATIONS

BACKGROUND OF THE INVENTION

1. Field of the Invention

The present invention relates to decorative accessories for clothing, hair, or other similar and suitable places. Particularly the presently disclosed device is useful for securing a person's hair in place with a different decorative item with attachable and interchangeable decorations or ornaments, providing a decorative fashion accessory for the hair made primarily of chains and beads.

2. Description of the Related Art

Despite the fact that the basic design of headbands, barrettes, and hair combs has remained unchanged for a significant period of time, the ongoing demands of constantly changing fashion trends require a costly accumulation of hair controlling devices basically identical in structure, but different solely in the decorations or ornaments adorning the devices. The prior art reflects the desire to adapt to fashion trends, while minimizing the number of hair controlling devices by means of hair controlling devices with interchangeable decorations.

U.S. Pat. No. 6,237,611 B1, issued to LeCrone et al. in 2001, discloses a banded clothing device with pockets to receive ornaments. Such ornamentation may be in the form of clips, barrettes, hair pins or bobby pins having ornamentation such as bows, ribbons, flowers and the like.

U.S. Pat. No. 5,427,123, issued to Odenthal in 1995, discloses a headband kit with removable panels, interchangeably attachable to the display surface by means of a friction fit within mounting holes.

Another interchangeable barrette assembly with ornamental components is seen in U.S. Pat. No. 6,142,158, issued to Lloyd et al. in 2000, which discloses an interchangeable barrette assembly, comprising an ornamental component with posts that snap into the body of the removable clasp assembly.

U.S. Pat. No. 6,289,903 B1, issued to Haufler in 2001, describes a hair band consisting of a wearable body and a cord adapted to be woven through at least a portion of the body, the cord securing the ornaments to the body.

Hook-and-loop fastening systems (Velcro®) are in widespread use on numerous consumer products, including fashion accessories. U.S. Pat. No. 5,706,836, issued to McKeown in 1998, discloses a variety of hair ornamental and hair control devices utilizing a Velcro® system of hook-and-loop fasteners to comfortably and securely attach the ornament to the head. However McKeown utilizes hook-and-loop fasteners to secure the hair controlling device to the hair rather than to the hair controlling device.

U.S. Pat. No. 6,131,585, issued to Reinstein et al. in October 2000, discloses a hair ornament attachment system having decorative ornaments with hook fastening material on its reverser side for directly affixing the ornament to the hair and not the surface of a hair controlling device. Additionally, Reinstein et al. disclose a display unit consisting of loop fastening material for storing the ornaments when not in use.

U.S. Pat. No. 6,082,371, issued in July 2000, to Bader-Saltzman et al., discloses a novel hair clip utilizing hook-and-loop fastening for attaching hair decorations to the barrel of the hair clip. Additionally, U.S. patent application Ser. No. 2002/0066462 A1, published in June 2002, applied for by Denebeim, discloses a headband consisting of a strip of hook type fastening material on one side and loop type fastening material on its reverse side, said strip capable of attaching its ends to itself around a person's head, and capable of having attached to it, a variety of ornaments and or hair attachments.

None of the above inventions and patents, taken either singularly or in combination, is seen to describe the presently disclosed device as claimed. Thus a hair ornament kit with interchangeable decorations and a storage board solving the aforementioned problems is desired.

SUMMARY OF THE INVENTION

The invention relates to a decorative device with interchangeable decorative features. The preferred embodiment is a barrette with extended ends on each end opposite to each other. These additional ends provide a means to attach a chain, rope, or other similar strand between the two ends. The preferred embodiment further contains beads, stickers, hooks, or other decorative items attached to the chain by various attachment means including, but not limited to, hooks, glue, threading, and wire.

The preferred barrette is generally an elongated flat surface with a clip or other attachment means affixed to the underside of the generally flat surface for securing the barrette to a specific position on the desired piece of clothing, footwear, shoes, luggage, backpacks, hair, and any other device or item someone may wish to decorate.

The barrette has two extended ends opposite to each other to which the chain, rope, etc. are attached to the barrette by means of screws, hooks, glue, magnets, rare earth magnets or other similar attachment means. The chains or ropes have decorative ornaments attached to them, thus allowing the decorative ornaments to be fastened to the barrette and easily interchanged with other decorative ornaments to provide different fashion appearances.

DETAILED DESCRIPTION

Figure 1:
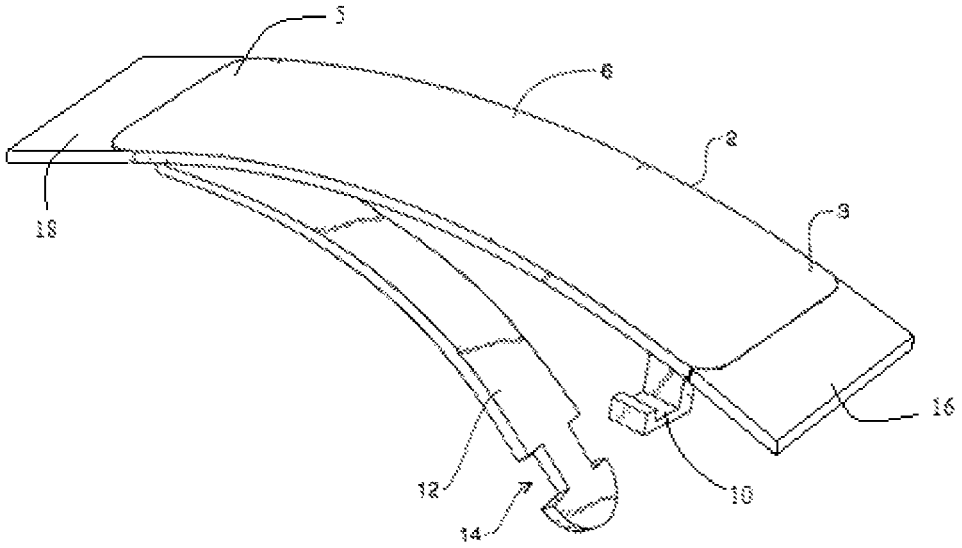
FIG. 1 is a perspective view of the presently disclosed device.

The present disclosure is directed to a decorative item with an interchangeable portion. The presently disclosed device can be attached to the hair, clothing, or other suitable surface and has an interchangeable decorative feature that does not require the purchase of a large number of similar items to vary the appearance of the decorative item. The preferred embodiment of the device is similar in nature to a barrette with the inclusion of two attachment means on opposing ends of the barrette. The interchangeable decorations can be attached to the attachment means on the barrette.

Decorative items such as charms, beads, bracelets, and barrettes are widely known in the art. However, there is a limited amount of variance in these items, especially as it relates to the ways that these items can be displayed on a person, clothing or other item. Customization of these items is a rapidly growing area of the art and new ways of interchanging parts is highly sought after. The presently disclosed device will allow a user to frequently and easily customize these decorative items by interchanging only a portion of the device saving money and time in the manufacturing process and to the consumer.

The presently disclosed device allows for a more personal way to create customizable decorations. There is no device currently on the market that will have this level of customization. Currently if a consumer wishes to have a different look with a barrette with beads or charms, the consumer would have to purchase a completely different piece.

In one embodiment of the device, the main body of the barrette is constructed of a light-weight metal, plastic, or other similar material that is moldable. The main body of the barrette will be of varying length from one inch to 5 inches or more. The main body of the barrette may or may not have an opening in the center depending on the desired look and strength of the barrette. The main body of the barrette may be straight, have a concave bend, or a convex bend in it.

Additionally, in this embodiment, there will be two additional pieces of material such as light-weight metal, plastic, elastic, rope, chain or other similar material that will act to allow the barrette to be attached to another object. The first end piece will be attached to one end of the barrette, while the second end piece will be attached to the second end piece. The first end piece and second end piece will be at least half as wide as the barrette and can be up to one hundred and fifty percent wider than that barrette. Additionally, the first end piece and second end piece will typically be one inch to four inches long, and most preferably be one and a quarter inch to two inches long. The first end piece and second end piece may have a hole or slot at or near the middle of the end pieces to allow for the attachment of a decorative device or chain. Additionally, the first end piece and second end piece will either be straight, have a convex curve or concave curve so as to match the main body of the barrette.

The barrette will also have a metal, plastic or other moldable material hinge which will secure the main body of the barrette to the bottom band of the barrette. The bottom band of the barrette is designed to have a material, hair, or clothing placed between the bottom band and the main body such that when the bottom band is latched to the main body, the barrette will stay in place. The bottom band of the barrette and the main body of the barrette are attached to each other by the hinge at one end and a clasp at the other end. The clasp is made from light-weight metal, plastic, or other similar material that is moldable.

In another embodiment of the presently disclosed device, the first end piece will have a first end of a chain, loop, rope or other similar item permanently attached to it. This attachment is accomplished by a post on the underside of the first end piece and the first end of the loop, post, chain or other similar item passing through a hole or slit in the first end piece and attaching to the post on the underside of the first end piece. This attachment will secure the chain, rope, clasp, or loop to the first end piece. The second end of the rope, chain, clasp, or loop will have a means to connect it to a second post located on the underside of the second end piece. The first and second end of the rope, chain, clasp, or loop will be sized to allow the placement of beads, charms, or other decorative items on them. These can be by a male or female screw type connection, magnetic, loop, clasp, or other attachment means. It is extremely important that the second end of the chain, rope, loop or other similar item can be easily opened and securely closed.

While any formable material will work to create the presently disclosed device, there is no limit on what the presently disclosed device can be created from. There could be different closure options for securing the chain, rod, or similar device to the first and second end pieces. There are also other options for how the device accessory can be connected to a third object such as adhesives, string, wire, thread, sewing, or other similar means. This device could be put onto a hair comb or other decorative accessories such as a pin, etc. It could be used for adults, children, pets.

They would unscrew the side that can open and then place their own mix of charms/beads and then screw back together the two pieces and then place in the hair. Additionally: The chain or rod could be affixed to other items in order to customize that item's appearance with the use of beads or charms. An example would be a pen or head bands or combs. This item could be used as a decorative item for pets.

Referring now to the attached drawings, the presently disclosed device will be discussed in more detail. As seen in FIG. 1 the disclosed device consists of a main body, 2, an upper side, 6, a first end, 5, and a second end, 3. In addition the device has a first end piece, 18, extending beyond the first end, 5, of the barrette. The device also has a second end piece, 16, extending beyond the second end, 3, of the barrette. The first end piece, 18, and second end piece, 16, are designed such that a second object can be attached to either or both ends. This object is a chain, cord, clasp, rope, or other item that can be operatively connected to either end. The device also has a clip, 12, attached to the underside of the main body, 2, near the first end, 5. The clip, 12, has a latch, 14, and a hook, 10, that can be used to secure the barrette to a third object such as a piece of clothing, footwear, shoes, luggage, backpacks, hair, and any other device or item someone may wish to decorate.

Figure 2:
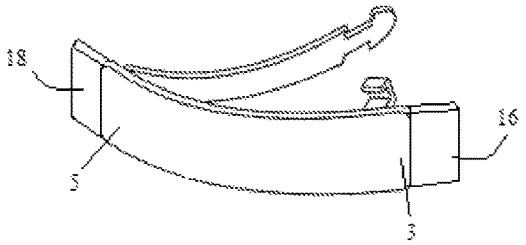
FIG. 2 is a side-perspective view of the presently disclosed device.

Referring to FIG. 2, a side view of the device can be seen. FIG. 2 shows the curvature of the main body and how this curvature is continued from the first end, 5, and second end, 3, to the first end piece, 18, and second end piece, 16.

Figure 3:
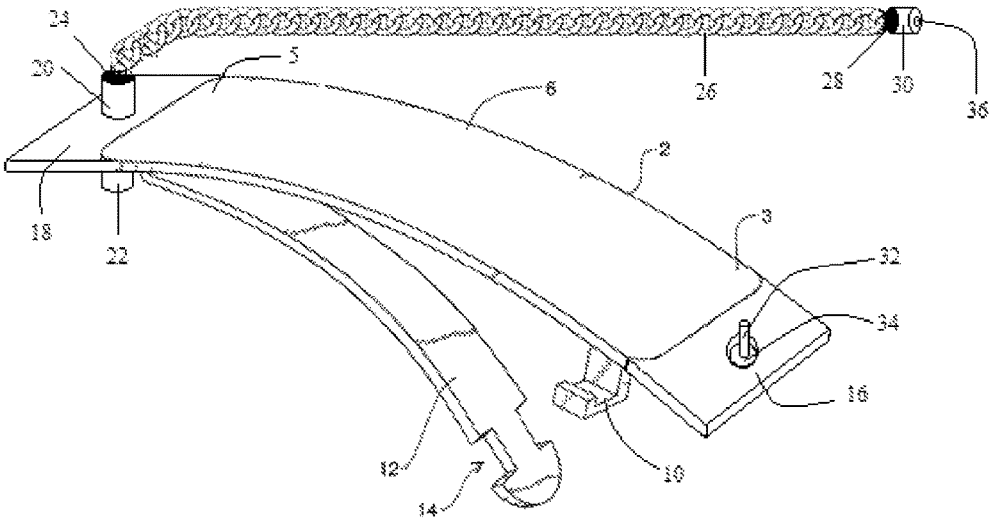
FIG. 3 is a perspective view of a second embodiment of the presently disclosed device.

FIG. 3 shows a second embodiment of the device. In FIG. 3 the disclosed device consists of a main body, 2, an upper side, 6, a first end, 5, and a second end, 3. In addition the device has a first end piece, 18, extending beyond the first end, 5, of the barrette. The device also has a second end piece, 16, extending beyond the second end, 3, of the barrette. The first end piece, 18, and second end piece, 16, are designed such that a second object can be attached to either or both ends. As shown in FIG. 3, the first end piece, 18, has a first bottom attachment device, 22, a first top attachment device, 20, and a connector, 24. The connector, 24, is attached to the top attachment device, 20, and the chain, 26, at one end of the chain. The opposite end of the chain has a second connector, 28, and a second top attachment device, 30. The second top attachment device, 30, has a female connector end, 36, which will attach and securely connect to the male attachment piece, 32, located on the second bottom attachment device, 34. The device also has a clip, 12, attached to the underside of the main body, 2, near the first end, 5. The clip, 12, has a latch, 14, and a hook, 10, that can be used to secure the barrette to a third object such as a piece of clothing, footwear, shoes, luggage, backpacks, hair, and any other device or item someone may wish to decorate.

It is to be understood that the present invention is not limited to the embodiments described above, but encompasses any and all embodiments within the scope of the following claims.

We claim:

1. A decorative device consisting essentially of:

a barrette having an elongate main body having a flat upper surface and an opposing flat bottom surface and opposing first and second lateral side surfaces disposed between the upper and bottom surfaces, where a central axis is defined between the opposing first and second lateral side surfaces;

a clip pivotably attached to the bottom surface of the barrette main body in an area proximate the first lateral side surface, and a hook disposed on the bottom surface of the barrette main body in an area proximate the second lateral side surface, where the clip engages the hook to define a closed configuration and is detachable from the hook to define an open configuration;

a first lateral end piece and a second lateral end piece, where each lateral end piece has a flat upper surface, a flat bottom surface and opposing first and second lateral side surfaces disposed between the upper and bottom surfaces;

wherein the second lateral side surface of the first end piece is attached to the first lateral side surface of the barrette main body and the first lateral end piece extends outwardly from the barrette main body and is aligned with the central axis of the barrette main body such that the first lateral side surface of the first end piece defines a first terminal lateral side of the decorative device;

wherein the first lateral side surface of the second end piece is attached to the second lateral side surface of the barrette main body and the second lateral end piece extends outwardly from the barrette main body and is aligned with the central axis of the barrette main body such that the second lateral side surface of the second end piece defines a second terminal lateral side of the decorative device;

wherein the upper and bottom surfaces of the barrette main body and the first and second lateral end pieces are flush with one another;

wherein the first and second end pieces are made of a different material than that of the barrette main body;

a first attachment piece protruding from the upper surface of the first lateral end piece and a second attachment piece protruding from the upper surface of the second lateral end piece;

and an elongated decorative element having a first connector at a first end and a second connector at an opposing second end, where the first and second connectors are detachably coupled to respective first and second attachment pieces such that the elongated decorative element extends from the first lateral end piece to the second lateral end piece along the central axis and spaced apart from the barrette main body.

* * * * *